United States Patent [19]

Marc

[11] 4,435,910

[45] Mar. 13, 1984

[54] SHOE INSOLE

[76] Inventor: Michel Marc, 48 Ridge Hill Farm Rd., Wellesley, Mass. 02181

[21] Appl. No.: 357,784

[22] Filed: Mar. 12, 1982

[51] Int. Cl.[3] ..... A43B 13/38; A43B 13/40; A43B 21/32

[52] U.S. Cl. ..... 36/44; 36/37; 128/614

[58] Field of Search ..... 36/44, 43, 37, 71, 30 R; 128/614, 595

[56] References Cited

U.S. PATENT DOCUMENTS

| | | | |
|---|---|---|---|
| 2,379,366 | 6/1945 | Lumbard | 36/37 |
| 4,120,102 | 10/1978 | Kenigson | 36/37 X |
| 4,167,824 | 9/1979 | Wolpa | 36/44 |
| 4,268,980 | 5/1981 | Gudas | 36/43 |

FOREIGN PATENT DOCUMENTS

| | | | |
|---|---|---|---|
| 1937373 | 1/1970 | Fed. Rep. of Germany | 36/43 |
| 2010635 | 9/1971 | Fed. Rep. of Germany | 36/44 |
| 474465 | 9/1952 | Italy | 36/44 |
| 327015 | 3/1930 | United Kingdom | 36/37 |

*Primary Examiner*—James Kee Chi

*Attorney, Agent, or Firm*—Wolf, Greenfield & Sacks

[57] ABSTRACT

A shoe insole having a substantially flat base layer and constructed in particular as a running shoe having an improved arch and heel support including, in addition to, the base layer, a resilient intermediate layer affixed to and overlying the rear portion of the base layer and adapted to conform to the foot having a cupped back for accommodating the heel and a side crown for accommodating the arch. The resilient layer is formed thicker at the cupped back to absorb maximum impact usually concentrated thereat and thinner at the side crown so as to provide improved flexibility.

10 Claims, 6 Drawing Figures

12
14
26
14
10
24
25

25
10
24
26
14
12

14A
24
14
14
15
12
14B
16
10

SHOE INSOLE

BACKGROUND OF THE INVENTION

The present invention relates in general to a improved insole for shoes and pertains, more particularly, to an improved insole for running shoes, sneakers or the like.

Running shoes are presently constructed using a preformed insole that is adapted to conform to the arch of the foot for improved comfort and support in running. The entire insole is usually preformed with a raised area that is initially molded to conform to the arch. However, once the shoe has been used, sometimes for only a short period of time the insole loses its preformed support and as a result support is lost particularly for the arch of the foot and also for other rear areas of the foot.

Accordingly, it is an object of the present invention to provide an improved insole, particularly for running shoes, sneakers or the like and which provides improved support and comfort for the foot with the support being provided in a substantially permanent basis. In accordance with the invention, the insole is connected so that the contour of the insole is maintained even after extensive use of the shoe.

Another object of the present invention is to provide an improved insole for running shoes having a heel section that is cupped for capturing the heel of the foot so as to avoid side motion of the foot in the shoe.

Still another object of the present invention is to provide an improved insole for running shoes which permits the insole to conform to the foot of each individual wearer.

A further object of the present invention is to provide an improved insole for running shoes that is light in weight weighing preferably approximately one ounce.

Another object of the present invention is to provide an improved insole for running shoes in which the insole is breathable and anti-bacterial.

Another object of the present invention is to provide an improved insole for running shoes in which the insole is comprised of a combination of different foams including an intermediate foam that displays a substantially perfect memory and that cushions and absorbs shocks. This foam is characterized by retaining its original position even after extensive use of the shoe.

SUMMARY OF THE INVENTION

To accomplish the foregoing and other objects of the invention, there is provided a shoe insole which is particularly adapted for use in running shoes, running sneakers or the like. This insole comprises three basic layers that incorporate a combination of different types of foam materials. There is provided a substantially flat base area and a resilient intermediate layer affixed to and overlaying the rear portion of the base layer and adapted to conform to the foot having a cupped back for accommodating the heel and side crown for accommodating the arch. The resilient intermediate layer, however, is no adapted to be in direct contact with the foot but instead there is provided preferably a top cushioning layer affixed to and overlying the base and intermediate layers and having a top surface which is adapted to be in direct contact with the foot. This top surface is, of course, also contoured having the cupped back and side crown configuration. The cupped back provides for a capturing of the heel of the foot to avoid side motion of the foot in the shoe. The side crown provides arch support. The resilient intermediate layer is preferably formed thicker at the cupped back to absorb maximum impact which is usually concentrated thereat during running. Thus, the cupped back is thicker than the area at the side crown whereby there is provided improved flexibility at the side crown so as not to interfere with a low arch foot. In accordance with the present invention in one embodiment, the base layer may be of polyethylene, the intermediate layer may comprise a polyvinylchloride material and the top layer may comprise either neoprene or a polyurethane foam. To provide the proper support, the intermediate layer has a plurality of substantially disposed ribs with each rib extending downwardly and with the top of the intermediate layer having a smooth contoured surface. The ribs are preferably spaced along the periphery of each intermediate layer with each rib being arcuate extending from a top peripheral edge of the layer to a central fin portion of the intermediate layer. To provide the more rigid support at the heel of the shoe in comparison to that at the arch, the aforementioned ribs are preferably spaced closer at the cupped back than at the side crown. Also, the ribs are preferably thicker at the cupped back than at the side crown. This has the effect of providing increased support at the heel where impact is concentrated and permits a softer support at the arch.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
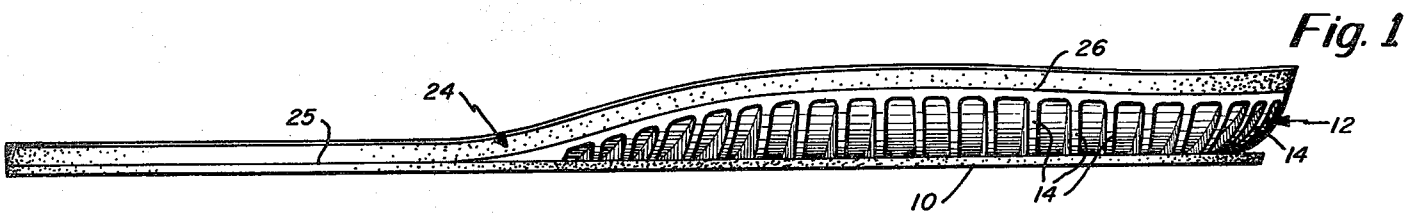
FIG. 1 is a side elevational view of the insole of this invention taken from the arch side.
Figure 2:
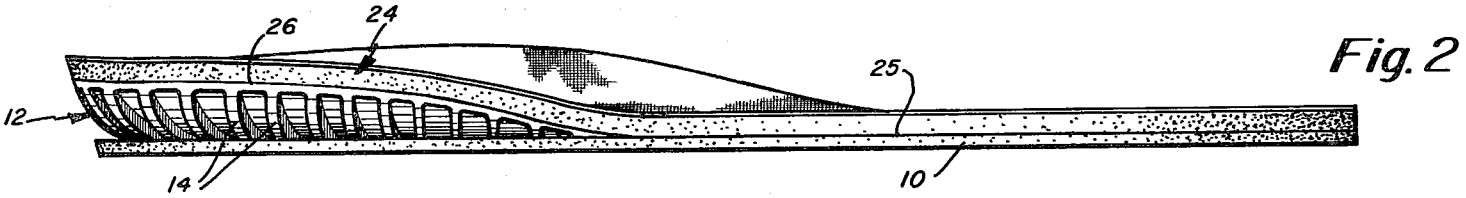
FIG. 2 is an opposite side elevation view of the insole shown in FIG. 1.

Referring to the drawing, there is shown a preferred embodiment of a shoe insole constructed in accordance with the principles of the present invention and adapted primarily for running shoes. The insole is constructed of a combination of different foam materials and is particularly adapted and constructed so as to provide a foot conforming surface that has a substantially perfect memory and which will retain its formed shape even after extensive use of the running shoe. The insole is also constructed so as to operate effectively in absorbing shock and impact of the foot particularly at the heel area. Furthermore, the insole is constructed so as to provide improved and proper support for the arch of the foot. The arch support in particular, in accordance with the insole of this invention is also maintained even after extensive use of the shoe in which the insole is employed. This insole may also be used either directly in the manufacture of shoes or can be sold separately as an insert to be used with previously worn running shoes.

Figure 3:
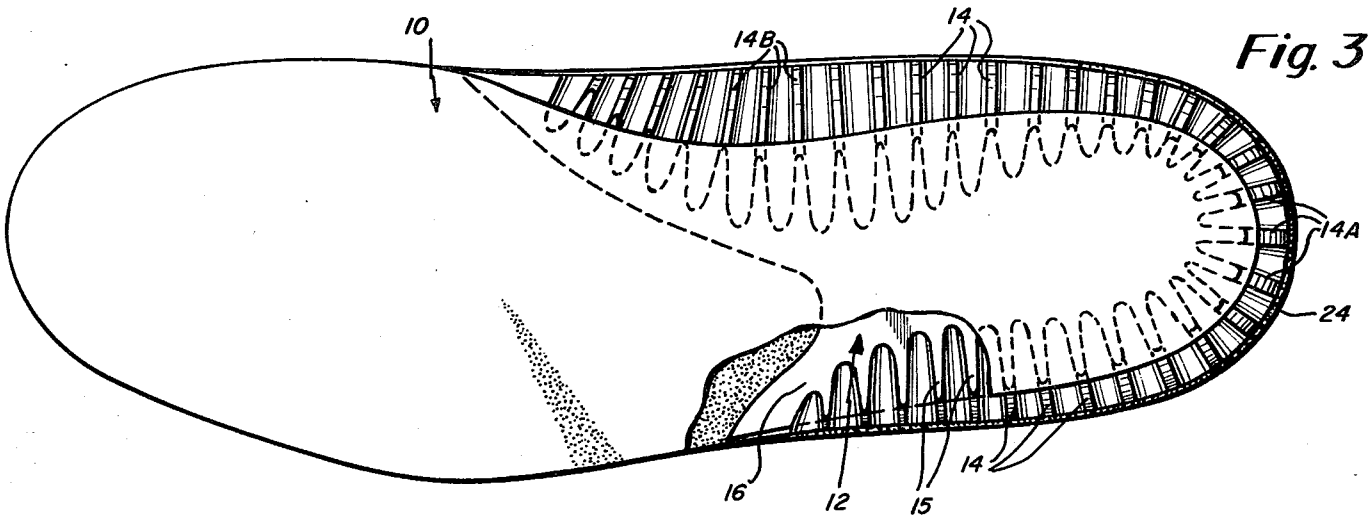
FIG. 3 is a bottom, partially cut away view of the insole of FIG. 1.
Figure 4:
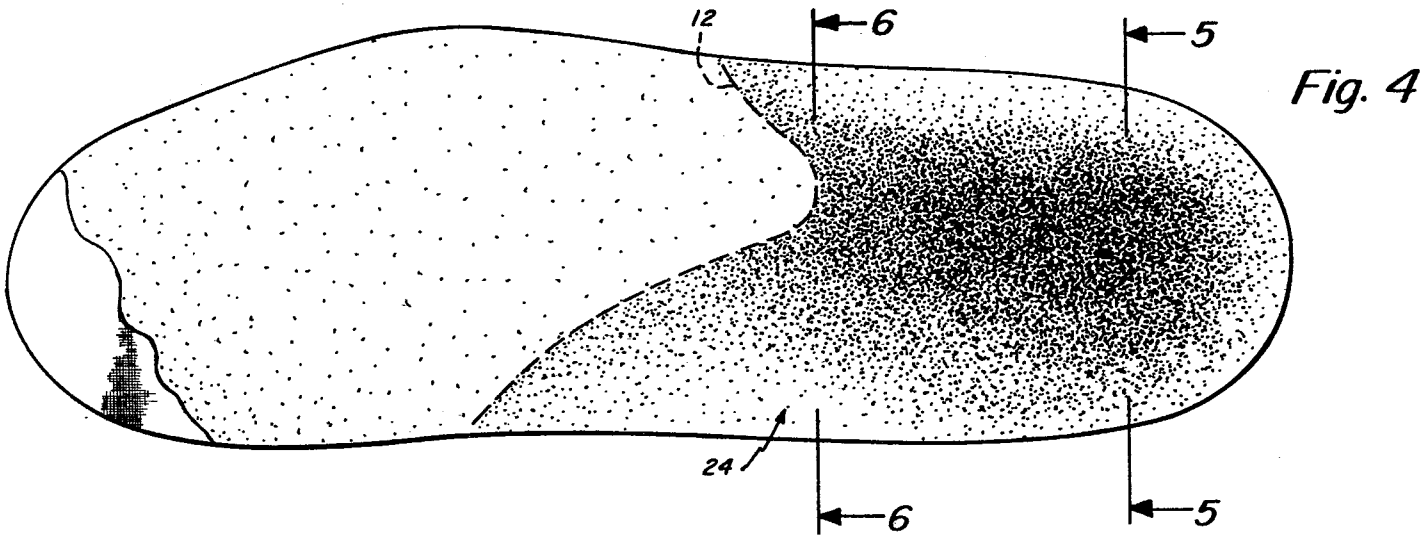
FIG. 4 is a top view of the insole of FIG. 1.
Figure 6:
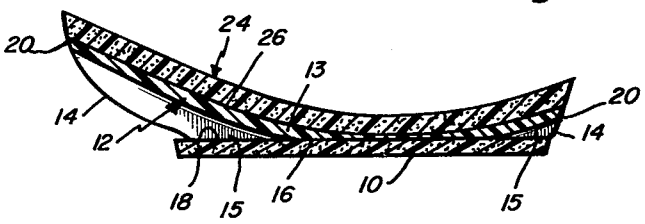
FIG. 6 is a cross-sectional view taken along line 6—6 of FIG. 4.
Figure 5:
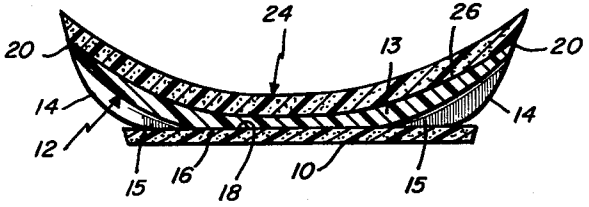
FIG. 5 is a cross-sectional view taken along line 5—5 of FIG. 4.

The insole shown in the drawing comprises a base layer 10 which is substantially flat but which, of course, has a contour matching that of the foot. This contour is shown in particular in the bottom view of FIG. 3. The base layer 10 is resilient and is adapted to collapse under pressure thus allowing the insole to conform to the foot of each individual. This base layer may be constructed of a cross-linked polyethylene with or without a small percentage of ethyl vinyl acetate foam. The top surface of the base layer 10 also forms a support surface for the intermediate member 12. The member 12 comprises a relatively thin layer 13 and a plurality of substantially radially disposed ribs 14 which essentially extend downwardly about the periphery of member 12 from the relatively thin layer 13. The bottom surface 16 of the layer 13 may be suitably glued to the top surface 18 of the flat base layer 10. The ribs 14 have an arcuate shape as indicated in FIGS. 5 and 6 and extend from the top peripheral edge 20 of the layer 13 to a fixed contact point with the top surface 18 of the base layer 10. Thus, the bottom 15 of each of the ribs 14 is essentially secured and fixed to the base layer. This provides good support for the ribs and holds the ribs in proper spaced relationship.

The ribs also provide a means of support with a minimum use of material so as to minimize the weight of the overall insole. Of the ribs 14, some of these are of different width than others. The widths may taper from area to area becoming gradually wider from the front toward the back of the insole. Thus, as depicted, for example, in FIG. 3 the rearwardly disposed ribs 14A are wider than the more forwardly disposed ribs 14B. Also, the spacing between the ribs 14A is preferably smaller than the spacing between the ribs 14B. There is thus provided a more bulky, thicker and resilient support at the heel area of the foot so that the heel can absorb shock which is typically experienced during running. On the other hand, the support is more resilient and essentially "softer" in the area of the ribs 14B under the arch of the foot. Also, for people with a low arch, this increased resiliency by the narrower ribs and wider spacing is advantageous.

The intermediate member 13 is preferably constructed of a foam material. Examples of this material include polyvinylchloride and polyvinylchloride foam. The polyvinylchloride foam functions as a memory and cushions and absorbs shock yet permitting the material to return to its initial position.

Finally, there is provided over the base layer 10 and intermediate member 13, the top cushioning layer 24 which is glued both at the interface 25 between layers 10 and 24 and at the interface 26 between the underside of layer 24 and the smooth top surface of layer 13. The top layer 24 is also preferably constructed of a foam material such as neoprene, S.B.R. or polyurethane foam. These different foam materials are preferably covered on the top with a nylon cloth which is the final top surface upon which the foot rests. The top layer 24, of course, conforms to the shape imparted to the insole primarily by the intermediate member 12 with its associated support ribs 14. The top layer essentially hides any indentations formed by marks from the toes occurring on the inside after long periods of wear.

Having described one embodiment of the present invention, it should now be apparent to those skilled in the art that numerous other embodiments area contemplates as falling within the scope of the present invention. For example, although the embodiment described is used in a running shoe, it is understood that the principles of the invention may also be applied in the construction of other types and forms of shoes including other types of athletic shoes.

What is claimed is:

1. A shoe insole comprising:

a substantially flat base layer, a resilient intermediate layer affixed to and overlying the rear portion of the base layer and adapted to conform to the foot having a cupped back for accommodating the heel and a side crown for accommodating the arch, and a top cushioning layer affixed to and overlying the base and intermediate layers and having a top surface adapted to be in direct contact with the foot, said resilient intermediate layer being formed thicker at the cupped back to absorb maximum impact usually concentrated thereat than at the side crown where there is provided improved flexibility so as to not interfere with a low arch foot, said intermediate layer having a plurality of substantially radially disposed ribs with each rib extending downwardly with the top surface of the intermediate layer having a smooth but contoured surface, said ribs being spaced along the periphery of the intermediate layer with each rib being arcuate extending from a top peripheral edge of the intermediate layer to a central thin portion thereof, said ribs being wider at the cupped back and at the side crown so as to provide enhanced impact absorption.

2. A shoe insole as set forth in claim 1 wherein the insole is for a running shoe with the layers being constructed of foam material.

3. A shoe insole as set forth in claim 2 wherein the base layer is polyethylene.

4. A shoe insole as set forth in claim 2 wherein the intermediate layer has a perfect memory and is of a polyvinylchloride material.

5. A shoe insole as set forth in claim 4 wherein the intermediate layer is PVC foam.

6. A shoe insole as set forth in claim 2 wherein the top layer comprises one of neoprene and polyurethane foam.

7. A shoe insole comprising;

a substantially flat base layer, a resilient intermediate layer affixed to and overlying the rear portion of the base layer and adapted to conform to the foot having a cupped back for accommodating the heel and a side crown for accommodating the arch, and a top cushioning layer affixed to and overlying the base and intermediate layers and having a top surface adapted to be in direct contact with the foot, said resilient intermediate layer having enhanced support at the cupped back to absorb maximum impact usually concentrated thereat, said intermediate layer having an unribbed substantially thin and flat central area and a plurality of substantially radially disposed ribs extending outwardly from and integrally form with said central area, said ribs including rearwardly disposed ribs and opposite side disposed ribs, said rear ribs all being of substantially the same length and said side disposed ribs on one side extending from said rear ribs with a progressive increase in length and on the other side extending from said rear ribs with a progressive decrease in length.

8. A shoe insole as set forth in claim 7 wherein said side disposed ribs on said one side have a progressive decrease in length after said progressive increase in length.

9. A shoe insole as set forth in claim 8 wherein said ribs are spaced along the periphery of the intermediate layer with each rib being arcuate extending from a top peripheral edge of the intermediate layer to said thin and flat central area.

10. A shoe insole as set forth in claim 9 wherein said ribs are thicker at the cupped back than at the side crown so as to provide enhanced impact absorption.

* * * * *